US006213009B1

(12) United States Patent
Sätman et al.

(10) Patent No.: US 6,213,009 B1
(45) Date of Patent: Apr. 10, 2001

(54) PROCESS OF CALENDERING

(75) Inventors: Nils-Erik Sätman; Thomas Berglind, both of Karlstad (SE)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/390,011

(22) Filed: Sep. 3, 1999

Related U.S. Application Data

(62) Division of application No. 09/213,107, filed on Dec. 18, 1998.

(30) Foreign Application Priority Data

Dec. 16, 1998 (SE) ..... 9804346

(51) Int. Cl.[7] ..... B30B 15/34; B30B 3/04

(52) U.S. Cl. ..... 100/38; 100/39; 100/47; 100/99; 100/172; 100/327; 162/206

(58) Field of Search ..... 100/35, 38, 39, 100/41, 47, 99, 170, 172, 173, 327; 162/206, 207, 255

(56) References Cited

U.S. PATENT DOCUMENTS

| | | | | |
|---|---|---|---|---|
| 4,518,460 | | 5/1985 | Hauser et al. . | |
| 4,555,305 | * | 11/1985 | Steiner et al. | 100/38 |
| 4,707,222 | * | 11/1987 | Mullner et al. | 100/48 |
| 4,799,997 | * | 1/1989 | Thompson | 162/255 |
| 5,011,578 | | 4/1991 | Lange et al. . | |
| 5,043,046 | | 8/1991 | Laapotti . | |
| 5,071,513 | * | 12/1991 | Bluhm et al. | 100/38 |
| 5,076,891 | * | 12/1991 | Link et al. | 100/38 |
| 5,084,137 | | 1/1992 | Ilmarinen et al. . | |
| 5,098,523 | | 3/1992 | Ilmarinen et al. . | |
| 5,141,601 | | 8/1992 | Karlsson et al. . | |
| 5,163,364 | | 11/1992 | Bubik et al. . | |
| 5,164,047 | | 11/1992 | Koski . | |
| 5,556,514 | | 9/1996 | Didier . | |
| 5,582,689 | | 12/1996 | Van Haag et al. . | |
| 5,784,955 | * | 7/1998 | Conrad | 100/172 |
| 5,816,146 | | 10/1998 | Wagner et al. . | |

FOREIGN PATENT DOCUMENTS

| | | |
|---|---|---|
| 0 442 257 A1 | 8/1991 | (EP) . |
| 2 182 367 | 5/1987 | (GB) . |

* cited by examiner

*Primary Examiner*—Peter Vo
*Assistant Examiner*—Louis K. Huynh
(74) *Attorney, Agent, or Firm*—Alston & Bird LLP

(57) ABSTRACT

The invention relates to a method for operating a calender, comprising a cylindrical heated roll and a flexible belt surrounding a stationary support beam which supports at least one actuator which may urge a concave load shoe against the heated roll by means of said flexible belt to form an extended and heated nip through which a fiber web passes to be calendered and a separating mechanism for having at least one of the rolls movable into and away from the nip characterized in that said flexible belt is a flexible tubular jacket which forms a part of an enclosed shoe roll such that the ends of said jacket have end walls mounted thereto, which end walls are rotatably mounted in relation to said support beam, and in that at least one of said end walls is driven by means of a drive arrangement which drive arrangement may be activated to drive the end walls and thereby also the jacket independently of its position in relation to the fiber web or the heated roll.

5 Claims, 12 Drawing Sheets

PROCESS OF CALENDERING

CROSS-REFERENCE TO RELATED APPLICATION

This application is a divisional of pending U.S. patent application Ser. No. 09/213,107 filed Dec. 18, 1998.

TECHNICAL FIELD

This invention relates to a method and apparatus for performing calendering of a fiber web, preferably using an enclosed shoe roll.

PRIOR ART AND PROBLEMS

Calendering of paper is performed in order to achieve a smooth surface of a fiber web, e.g. paper. Traditionally this is achieved by using two counter-acting rolls forming a nip within which a high pressure is applied to the paper surface in order to even out irregularities of the paper surface so as to form a smooth surface. A disadvantage by using the above mentioned method is that the high pressure acting on the web may cause excessive compaction of the web. As a result the thickness of the paper will be significantly reduced leading to relatively poor stiffness of the web after the calendering.

The above mentioned disadvantage can be reduced by using heat in combination with a relatively moderate pressure. The reason for this is that the fibers of the paper are plasticized if the temperature is sufficiently high (The temperature of plastification is normally about 170–210° C., i.e. depending on the moisture content and the properties of the fibers.) Accordingly if a sufficiently heated roll, e.g. 250° C., is used and sufficient heat transfer is achieved to the surface of the web passing the roll, a web may be produced having a smooth surface and relatively large thickness, which results in a much stiffer product than if a high pressure nip without heat would have been used.

For the above reason there are many applications where heat calendering is desired for the calendering process. A relatively recent problem in relation to heat calendering is the achievement of sufficient heat transfer, due to the trend towards higher and higher speed of the web. The faster the web moves through the nip the shorter time there will be for the transfer, i.e. shorter retention time. In U.S. Pat. No. 5,163,364 there is shown a method for solving the latter problem. U.S. Pat. No. 5,163,364 describes the use of an extended nip for obtaining sufficient retention time to ensure sufficient heating of the web surface during its travel through the nip. As shown in U.S. Pat. No. 5,163,364 the calendering zone is made up by a heated roll pressing from one side and an endless flexible belt which is pressed by means of a concave shoe press against the heated roll.

The endless flexible belt used in an extended nip is preferably made of a material that comprises polymers, resulting in relatively poor heat resistance, i.e. if the heat exceeds a certain temperature, normally about 80–100° C., the flexible belt will be destroyed. Since the cost of such a belt is considerably high any over heating of the flexible belt must be avoided. This can be achieved by the paper web absorbing almost all of the heat from the heated roll. There is also heat being produced inside the shoe press unit, which is transferred to the belt, i.e. the heat energy developed due to friction between the belt and the load shoe. To achieve cooling of the belt from this heat the lubricant which is supplied between the belt and the load shoe is circulated and cooled. However, if the paper web is broken, the flexible belt could be destroyed due to overheating, since the heated roll would then act directly on the flexible belt. This problem would be even worse if an enclosed shoe roll would have been used, since the cooling of an open flexible belt is easier to achieve than in a closed roll, i.e. an enclosed shoe roll.

Another related problem is the start-up process. Normally, the jacket of an enclosed shoe-roll is not driven by itself, but by means of friction once the nip is closed. It is evident for the skilled person that, in a calender the web could be negatively affected by such a starting-up process. Furthermore, such a start-up process also presents a possible risk of overheating of the belt at the moment of the start-up, since the belt does not move during the first contact with the web within the heated nip, i.e. an extreme heat transfer to the belt will occur.

SOLUTION AND ADVANTAGES

The object of the invention is to provide a process and apparatus which eliminates or at least minimizes the disadvantages mentioned above. This is achieved according to one aspect of the invention;

By a method for operating a calender, comprising a cylindrical heated roll and a flexible belt surrounding a stationary support beam, which supports at least one actuator which may urge a concave load shoe against the heated roll by means of said flexible belt to form an extended and heated nip through which a fiber web passes to be calendered, and a separating mechanism for having at least one of the rolls movable into and away from the nip characterised in that said flexible belt is a flexible tubular jacket which forms a part of an enclosed shoe roll such that the ends of said jacket have end walls mounted thereto, which end walls are rotatably mounted in relation to said support beam, and in that at least one of said end walls is driven by means of a drive arrangement, which drive arrangement may be activated to drive the end walls and thereby also the jacket independently of its position in relation to the fiber web or the heated roll.

The advantages of the present invention are several. The drive arrangement according to the invention enables opening and closing of the nip during operation without the risk of destroying the jacket due to overheating or damaging the flexible jacket, which results in cost savings and less downtime of the machine. Furthermore since the force from the drive arrangement interacts with the end walls of the enclosed shoe roll, and both end walls are rotated at the same rotational speed, the flexible jacket will not be negatively affected by the driving of the enclosed shoe roll, neither by wear on the jacket surface nor by tensional forces which otherwise might occur in the jacket itself. Moreover, by the possibility of axially displacing one end wall, the tension of the flexible jacket in an axial direction may be adjusted during operation, and thereby reducing the wear of the jacket due to local stress of the jacket in different directions.

Accordingly, the invention provides a new and improved method and apparatus for producing paper or paperboard, which also after calendering thereof has a good stiffness, thanks to the arrangements which provides for sufficient heat transfer also at very high speed of the fiber web such that the surface of the web will be plasticized and given an even surface by the use of a moderate pressure without suppressing the porous structure of the core of the fiber web.

According to further aspects related to the invention, the drive arrangement is activated before the nip is closed in order to ensure a desired speed of the jacket at the moment of closure of the nip, the speed of the web is measured and the speed of the jacket is synchronized with the speed of the web before it is brought into contact with it, there is a detecting device, which detects if the paper web is broken and a control system interconnected with said detecting device in such a manner that said drive arrangement is activated if the web is broken and also at the same time that a separating mechanism is activated to move the heated roll and/or the jacket away out of contact with the other, the speed of the web exceeds 600 m/min, preferably exceeds 800 m/min, and more preferably exceeds 1000 m/min, but is less than 4000 m/min, the web being produced is paper whereby the speed of the web exceeds 1000 m/min, preferably exceeds 1500 m/min, and more preferably exceeds 1800 m/min, the temperature of the surface of said heated roll is between 150–350° C., preferably exceeds 170° C., and more preferably is about 200–250° C., the linear load within the nip is 100–500 kN/m, preferably less than 400 kN/m, and more preferably about 320–380 kN/m, the linear maximum pressure within the nip is between 3–15 Mpa, preferably less than 13 Mpa, and more preferably about 8–12 Mpa, the force transmission from the drive arrangement to said force transmitting device is achieved by means of friction, the force transmission from the drive arrangement to said force transmitting device is achieved by means of a positively gripping drive arrangement, the end walls are axially displaceable such that the position and tension of the flexible jacket may be controlled also during operation of the enclosed shoe roll, a separating mechanism is arranged to the heated roll to move it out of contact with the jacket, a separating mechanism comprises a pivoting structure having at least one lever arm pivoting about an axis, which lever arm preferably is moved by means of an hydraulic assembly, the last step of achieving the nip involves urging the jacket out and above its unloaded position by means of the load shoe to press against the heated roll, a separating mechanism is achieved by moving the jacket out of contact with the heated roll by means of unloading the load shoe.

These and further aspects of the invention and the advantages with the invention will become apparent from the detailed description and from the attached claims.

DESCRIPTION OF THE DRAWINGS

The invention will be described more in detail below with reference to the appended drawings.

DETAILED DESCRIPTION OF EMBODIMENTS

Figure 1:
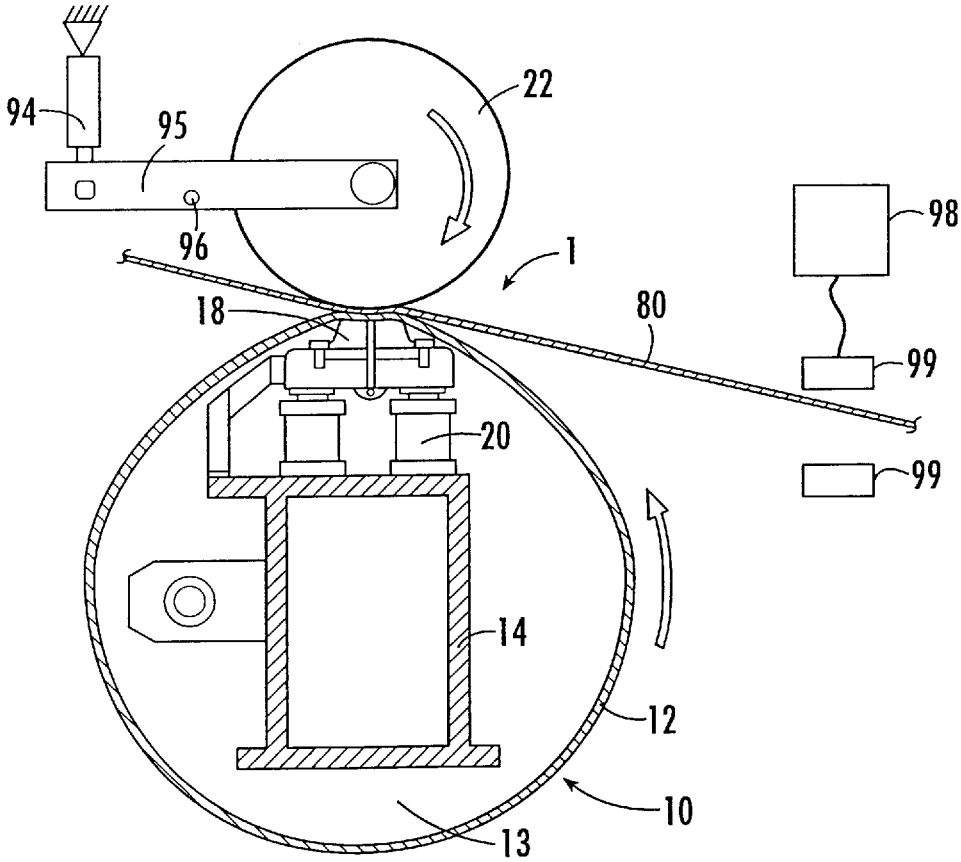
FIG. 1 is a schematic, sectional end view of a calender having an extended nip between an enclosed shoe roll and a counter-roll, according to the invention.

In FIG. 1 there is shown a fiber web 80 passing through an extended and heated nip 1. The nip 1 is formed by an enclosed shoe roll 10 positioned on the lower side in relation to the fiber web 80. On the upper side of the fiber web 80 there is shown a heated roll 22. The enclosed shoe roll 10 comprises a liquid impermeable flexible jacket 12, e.g. of a conventional type consisting of reinforced polyurethane. A stationary non-rotatable support beam 14 supports at least one load shoe 18. Between the load shoe 18 and the support beam 14 there is an actuator 20, in the preferred embodiment hydraulic pistons, for urging the concave load shoe 18 and thereby also the flexible jacket against the counter-roll 22. It should be noted that (contrary to what is "normal practice") the jacket is urged out of its unloaded position in a direction away from the center of the enclosed shoe roll. (In known shoe type presses the counter roll depresses the jacket inwardly.) The jacket 12 is attached to the outer periphery of two circular end walls 24, 26, such that a sealed compartment 13 (see FIG. 2) is obtained within the enclosed shoe roll. As also shown in FIG. 1, at least one detecting device 99 is arranged adjacent the fiber web 80, in order to detect if the web is broken. This detecting device 99 is connected to a control device 98 for controlling the operation of the calendering process in dependence of the fiber web 80 being broken or not.

Figure 1A:
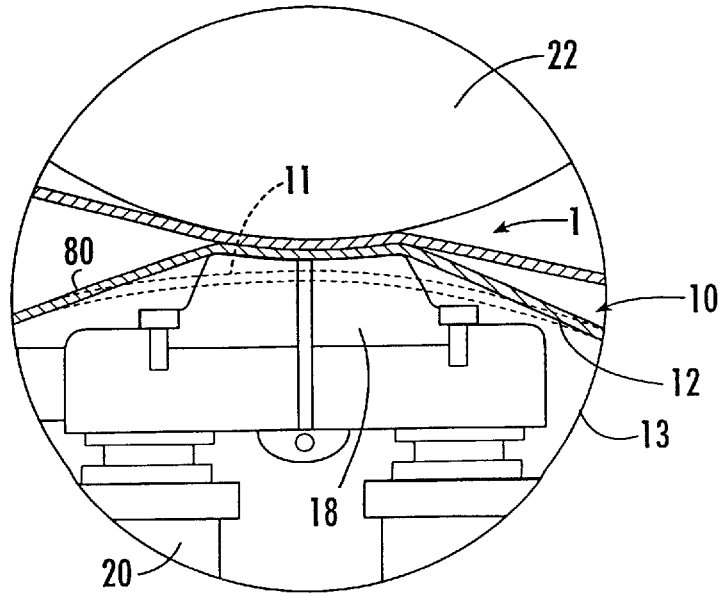
FIG. 1A shows an enlarged view of the nip of FIG. 1.

As schematically shown in FIG. 1 the heated counter-roll 22 is arranged on a movable lever 95 having a pivot point 96 and a hydraulic piston arrangement 94 for providing the possibility of moving the heated roll 22 into and away from the nip 1, which forms a part of a so called separating mechanism. In the preferred embodiment the separating mechanism comprises two mechanisms, a first mechanism for the movement of the load shoe 18 (the position of the jacket after unloading of the shoe is marked with reference numeral 11 in FIG. 1A) and a second mechanism for the movement of the counter-roll 22. At least one of the separating mechanisms is controlled by the above mentioned control circuit 98, such that the jacket is moved out of contact with the heated roll 22 as soon as the detecting device 99 detects a break of the fiber web. However, the movement of any separating mechanism shall also be operationable by manual control, e.g. in connection with inspection of the nip 1.

Figure 2A:
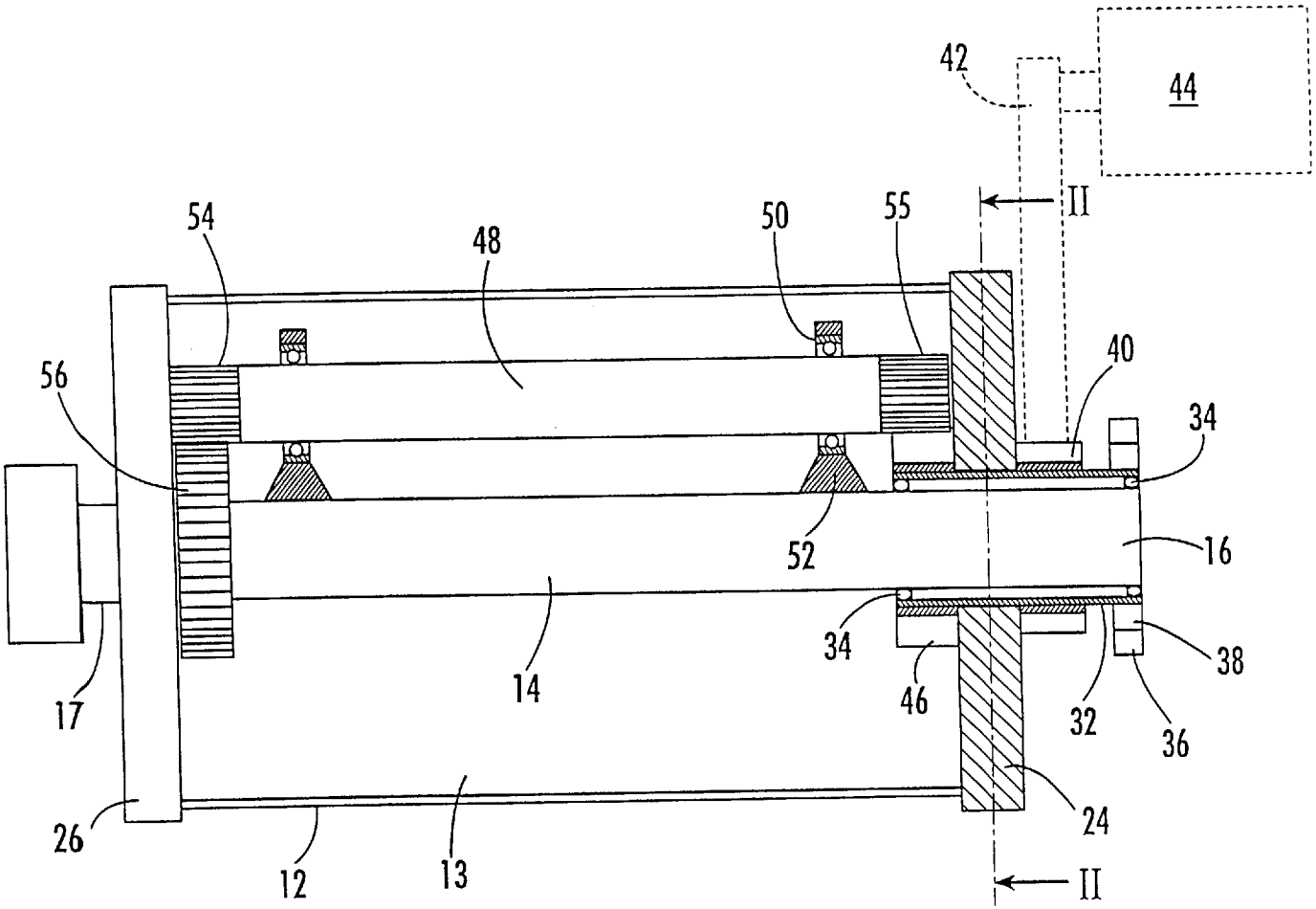
FIG. 2A is a partly cross sectional view of FIG. 1 along the axis of the device, showing a first drive arrangement.
Figure 2B:
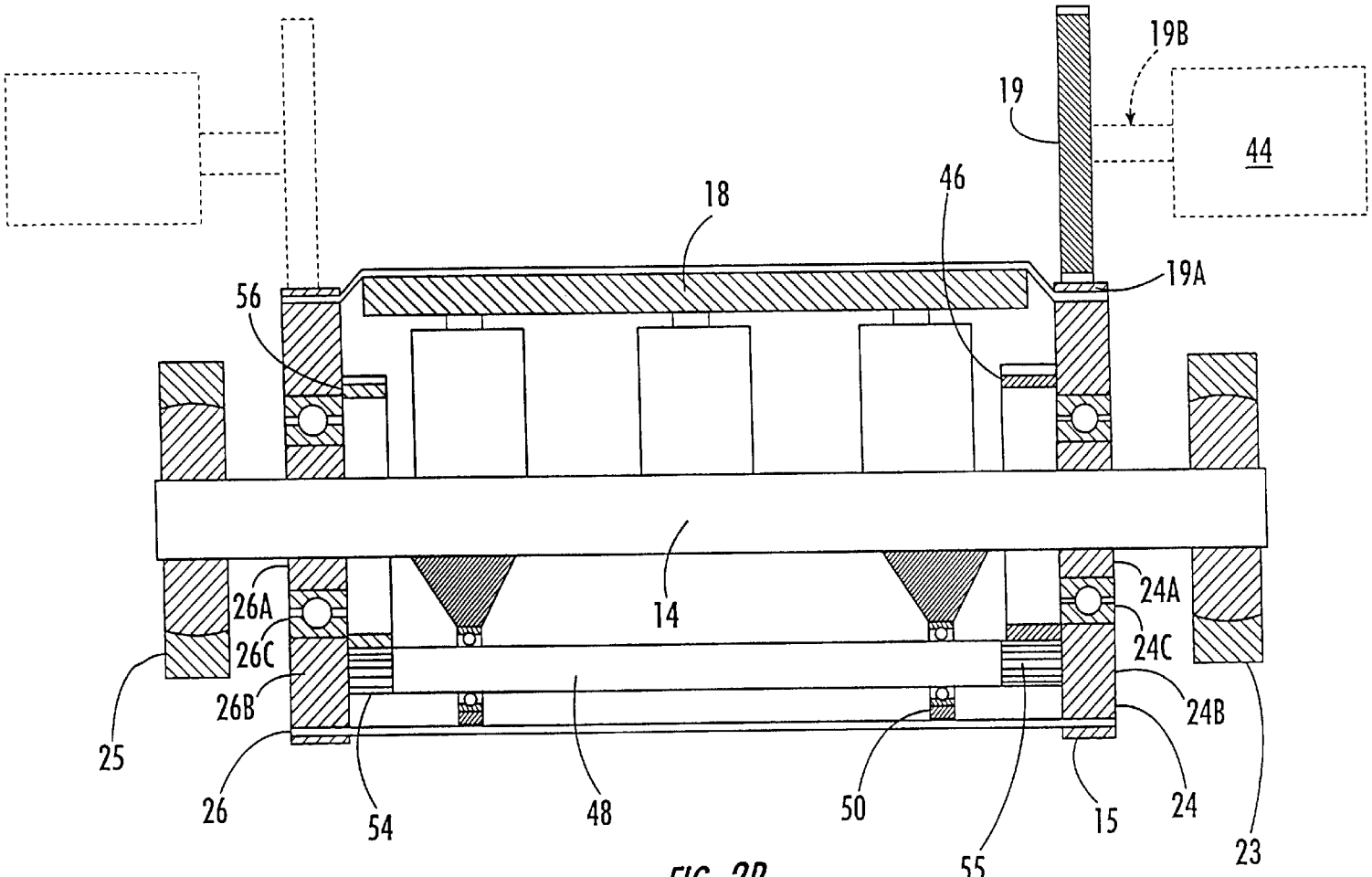
FIG. 2B is a partly cross sectional view showing a modified drive arrangement according to the invention and also schematically showing the action of the load shoe.

In FIG. 2A it is shown that the end walls 24, 26 are rotatably mounted on stub shafts 16, 17 of the support beam 14. (The end walls are preferably not integral but divided into a static part and a rotating part as shown in FIG. 2B). On one end of the stub shaft, a cylindrical shaft 32 is arranged rotatably via bearings 34. The support column 36 is arranged to the cylindrical shaft via self-aligning bearings 38, which allow spherical movement to allow the deformation/bending of the support beam 14 when heavily loaded. One of the end walls 24 is fixedly attached to the cylindrical shaft. A drive transmission 40 is fixedly attached to the cylindrical shaft outside the end wall, in the shown embodiment a cog wheel. The cog wheel is connected to a transmission 42 and in turn a drive 44. A cog wheel 46 is fixedly attached to the cylindrical shaft inside the end wall. A drive shaft 48 is arranged inside the jacket and parallel to the support shaft. The drive shaft is supported by bearings 50 arranged in bearing houses 52 attached to the support beam. At each end of the drive shaft, cog wheels 54 are arranged. Preferably these cog wheels have a prolonged toothed portion to allow axial movement of the intermeshing cog wheel which is attached to the end wall. A further cog wheel 56 is fixedly attached to the second end wall 26 inside the jacket. Both cog wheels inside the jacket mesh with the corresponding cog wheel on the drive shaft. The second end wall 26 is rotatably arranged on the second stub shaft 17. The second stub shaft is in turn fixedly attached to a second support column 58.

The function is as follows. During normal operation, the driven heated roll 22 interacts with the fiber web and the flexible jacket 12 by means of a desired pressure being exerted by the load shoe 18, thereby causing a friction based drive of both the fiber web and the flexible jacket. Accordingly, during normal operation the forces exerted in the nip provide for rotation of the enclosed shoe roll.

Merely during specific occasions there will normally be desired to operate the independent drive of the enclosed shoe roll 10. For instance, when starting-up of the calender is to be performed. If the calender should be started without first having speeded up the flexible jacket 12, this would inevitably cause damage to the flexible jacket due to overheating. Furthermore, it would also be deteriorating for the fiber web, since at the moment of start it would cause exceptional tension forces in the fiber web. Accordingly, the independent drive arrangement of the enclosed shoe roll is to be used for instance at the start-up of the calendering surface. At the start, the nip gap is not closed, but the roll 22 has been moved out of contact with the nip 1. Before moving the heated counter-roll 22 into the nip, the drive arrangement 44 of the enclosed shoe roll 10 is activated to accelerate the first end wall 24 via transmissions. The rotation of the end wall causes the inner first cog wheel 46 to rotate, and subsequently the drive shaft 48. The drive shaft transmits the rotation to the second end wall 26 via the second inner cog wheel 56. The both end walls are thus accelerated and rotate at the same speed until a peripheral speed is obtained which is desired, normally equal to the speed of the fiber web. The nip is closed by activating the hydraulic piston 94 to pivot the lever 95 and thereby moving the counter-roll 22 into the nip and subsequently the load shoe 18 is urged against heated roll 22 by means of its actuators 20. Once the calender functions in the desired manner, the drive arrangement of the enclosed shoe roll can be deactivated and the press roll driven in a conventional manner by means of friction within the nip 1.

Also for inspection of the enclosed shoe roll the operation in accordance with the above is desired since this will avoid closing down the whole machine. After inspection and possible adjustments or replacements of components with the paper web just moving through the gap between the rolls, the press roll is accelerated in the above manner, the nip is closed and the process continues without a risk of breaking or ripping the web.

It is to be understood that both end walls have to be driven and rotated with the same speed, since the flexible jacket cannot transmit any torsional forces.

In FIG. 2B there is shown an alternative embodiment of the drive arrangement for an enclosed shoe roll as shown in FIG. 1 (not using a positively gripping drive arrangement as shown in FIG. 2) This embodiment uses friction for transmission of rotational force.

FIG. 2B also shows a more preferred design of arranging the support beam and the end walls. The end walls are divided into a static inner part 24A; 26A, a rotational part 24B; 26B and a bearing 24C; 26C therebetween. Both of the static parts 24A; 26A are secured to the support column 14 such that they cannot rotate. However, preferably they are arranged such that they can be axially displaced, as is known per se and described in U.S. Pat. No. 5,084,137, in order to provide for movement and/or tensioning of the jacket, if desired. The support beam 14 is at its ends arranged with self-aligning bearings 23, 25 to allow the beam 14 to flex.

There is shown a drive 44 having a shaft 19B. On the shaft 19B there is arranged a disc 19 having a rubber layer at its peripheral end 19A. The outer ends of the flexible jacket 12 are fixedly attached between an annular ring 15, acting as a kind of force transmitting device 15 which can be exchanged after excessive wear, and the periphery of each end wall 24. The annular ring 15, which may be segmented, is fixedly attached to the end wall 24 in any appropriate manner, e.g. by screws. It is evident that the jacket can be secured to the end walls in many other ways, e.g. by a support (not shown) attached to the inner side of the end walls, which leads to a design where the frictional driving force preferably is transmitted directly to the outer surface of the end wall, i.e. the force transmitting device is integral with the end wall. It is of course also possible to attach a separate force transmitting device at the outer side of an end wall. On the inside of the rotational part 24B, 26B of each end wall there is fixedly attached a cog wheel 46; 56, having annular form. The drive arrangement 44, 19 is movable in or out of contact with said force transmitting device 15. Accordingly, when it is desired to accelerate the enclosed shoe roll 10, the drive arrangement is moved such that the rubber layer 19A comes into frictional engagement with the force transmitting ring 15. The cog wheel 46 and the drive shaft 48 will transfer the rotation of the end wall 24 to the other end wall 26 by means of the cog wheels 54, 55 and 56, which at the same time fulfils the function of a synchronizing device. Hence, this will cause both end walls 24, 26 to be operated in a corresponding manner as described above in relation to FIG. 2A. If needed there may be a drive on each side of the roll 10 interacting with each one of the end walls, whereby the transmission substantially merely acts as synchronizing device. In FIG. 2B it is also shown a schematic view of a preferred embodiment of the action of the load shoe 18. (Normally the load shoe 18 would not be positioned diametrically in relation to drive shaft 48, but perpendicularly as is shown in FIG. 1). It should be noted that, when each end wall has a drive of its own, it is also possible to eliminate the drive shaft 48 and achieve synchronization between the drives by other means. The load shoe is urged to push the flexible jacket 12 radially outwardly away from its normal resting position, to form the nip with the heated roll 22, as is explained more in detail below in relation to FIGS. 3A and 3B.

Figure 3A:
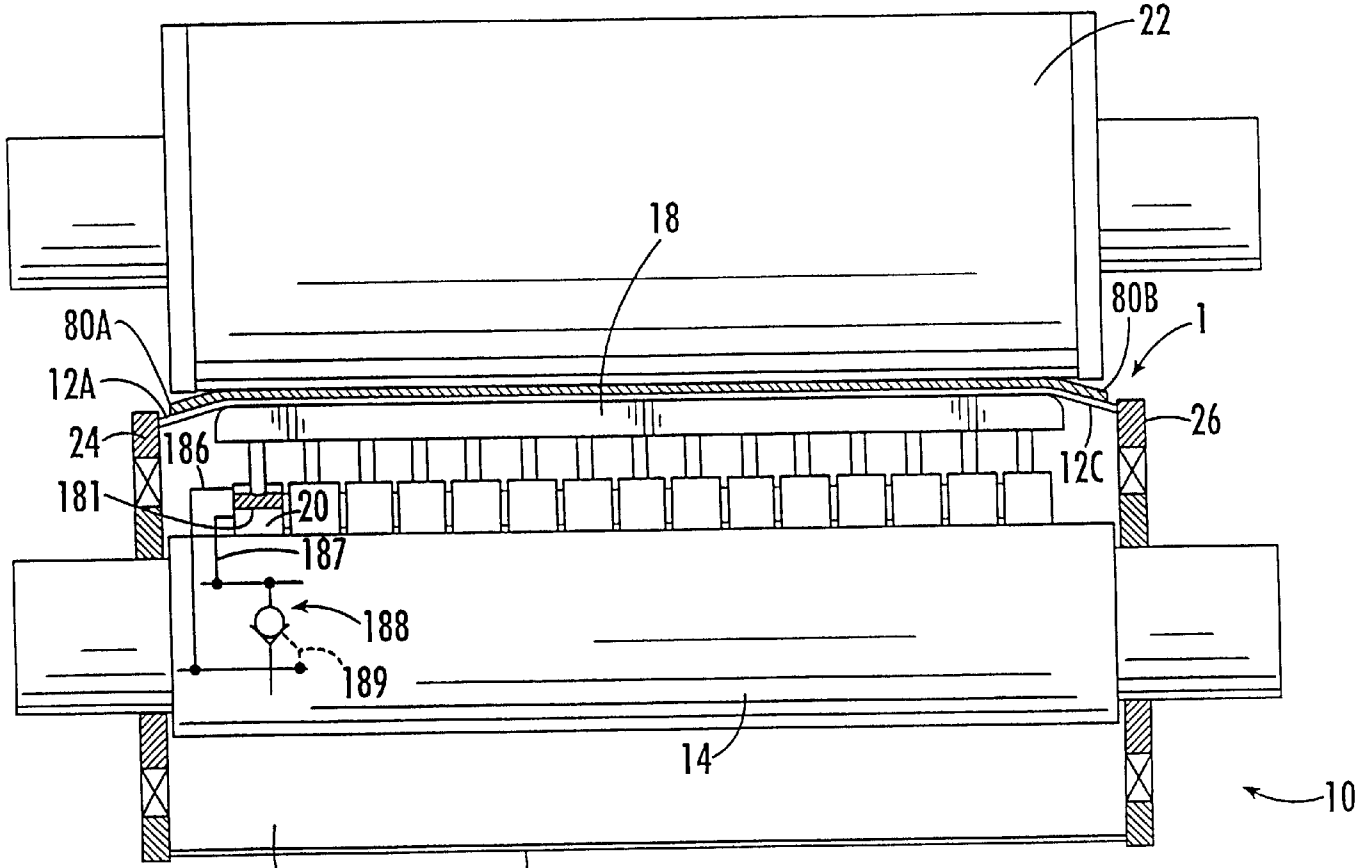
FIG. 3A is a cross sectional view of a calender in its nip-closing position schematically showing the actuator of the load shoe.
Figure 3B:
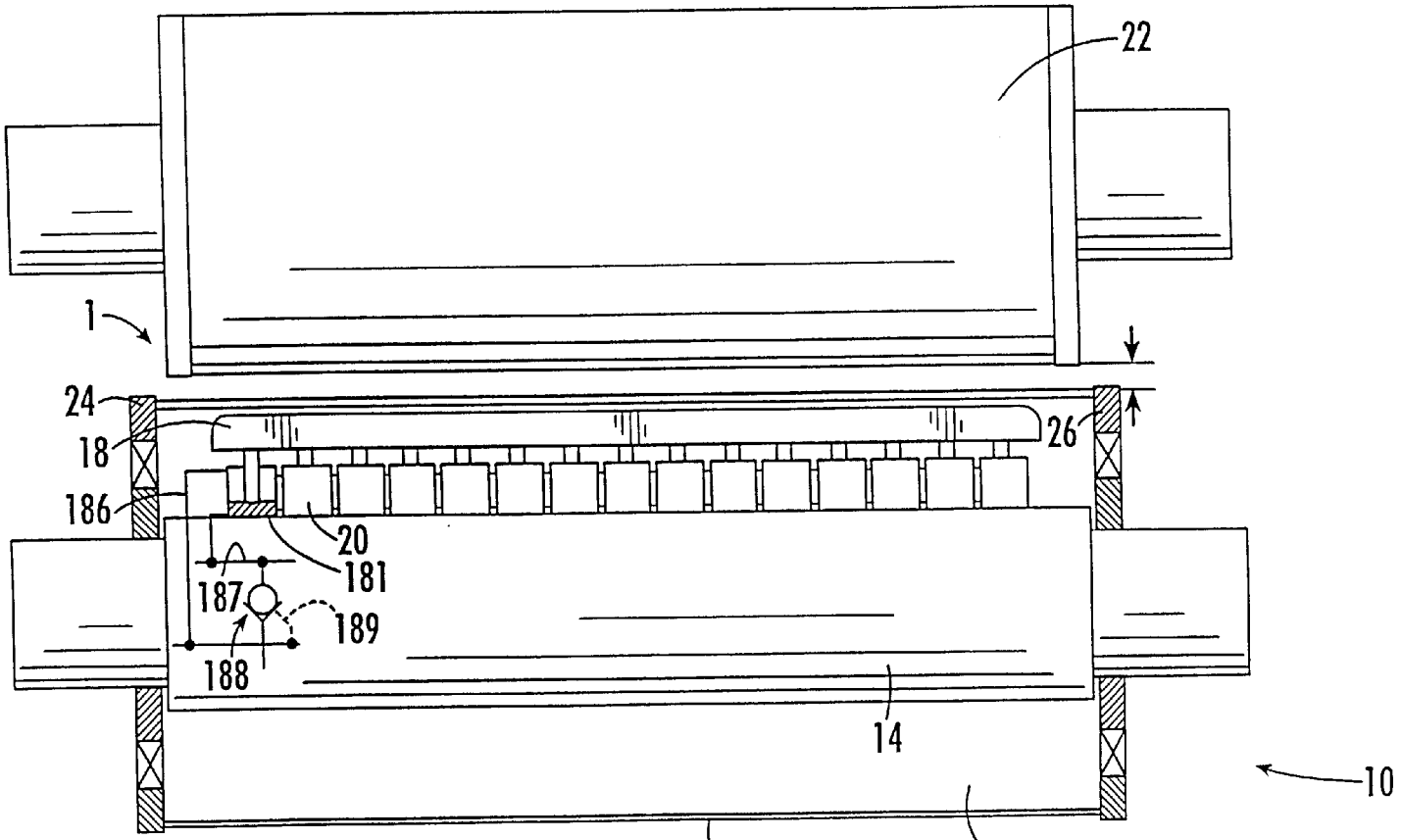
FIG. 3B is the same kind of view as FIG. 3A but with the nip in an open position.
Figure 3C:
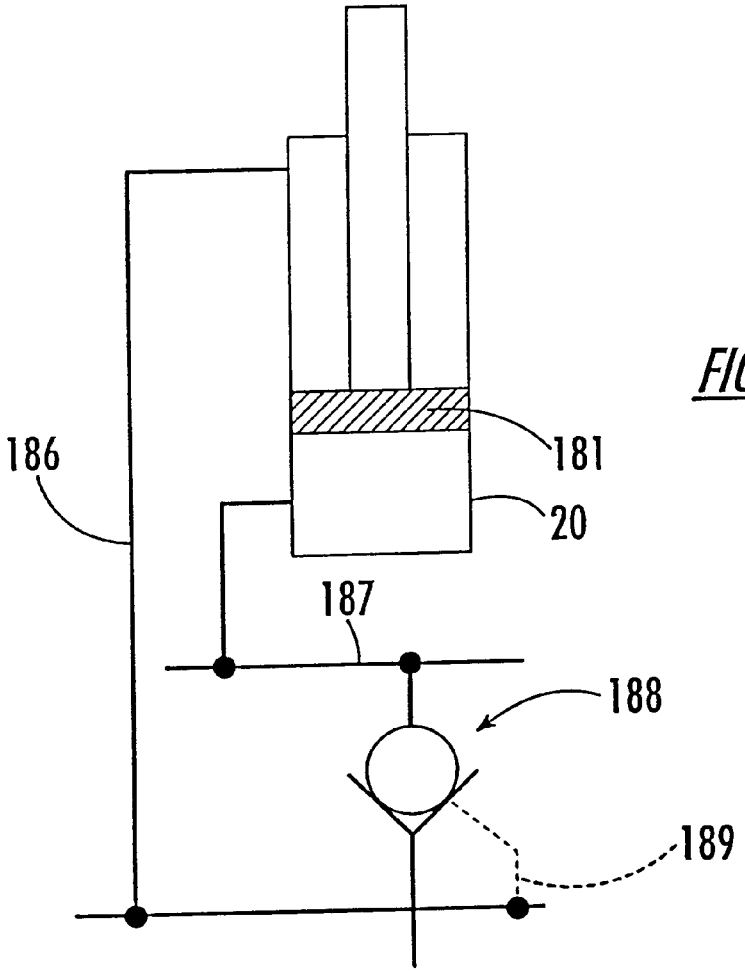
FIG. 3C is schematically showing one of the hydraulic pistons used in FIGS. 3A and 3B.

From FIGS. 3A and 3B it is evident that the load shoe 18 does not extend all the way between the end walls 24, 26. This is an arrangement needed for not endangering ripping of the flexible jacket 12, due to the load of the load shoe at its edges. Furthermore it is shown that also the heated roll 22 extends longer than the load shoe, which is needed to ensure optimal heat distribution/transfer within the nip and also to avoid heat expansion problems. Preferably heated oil is used to heat the roll. A desired temperature would normally be about 200–220° C. at the surface of the heated roll 22. The heated oil is supplied at the axial ends of the heated roll 22 which accordingly will have a higher temperature and therefore expand more. Of course, also other ways of heating are possible, e.g. heating by induction, steam or gas burners. However, also using these alternative heating methods lead to similar heat distribution problems, which are reduced by making the roll longer than the shoe. Furthermore it is shown that the heated roll 22 is positioned at a distance from the jacket 12, if the load shoe is in an unloaded state. To create a nip the load shoe 18 therefore has to press the jacket 12 outwardly, as shown in FIG. 3A which also shows that the web 80 has a wider extension than the load shoe. Movement of the load shoe 18 is achieved by the actuator 20, which in the embodiment illustrated in FIGS. 3A, 3B, and 3C comprises a number of hydraulic piston/cylinder assemblies having two-sided pistons 181. One end of the piston has a rod acting on the load shoe 18. The hydraulic fluid is schematically shown to be supplied and withdrawn by means of first and second pressure lines 186, 187 arranged within the enclosed shoe roll. In FIG. 3A, it is shown that the second pressure line 187 is pressurized and the first pressure line 186 is less pressurized which urges the piston 181 and the load shoe 18 upwardly to form a nip with the heated roll 22. The second pressure line 187 has a check valve 188, the check valve comprising a ball and a seat. Normally the distance which the jacket is moved out of its unloaded position would be about 5–10 mm. Accordingly, in the loaded state there exist two tapered zones 12A, 12C adjacent the nip, where no contact will exist between the jacket/web and the heated counter-roll 22 and which tapered zones will be substantially covered by the web 80 to protect the jacket from the heat of the heated roll 22.

To withdraw the load shoe from the nip, the first pressure line 186 is pressurized as shown in FIG. 3B, which urges the piston 181 and the load shoe to move downwardly (as illustrated) to form a gap with the heated roll 22. Advantageously, a pilot line 189 communicates the first pressure line 186 with the pilot check valve 188 so as to lift the ball from the seat when the first line is pressurized. This allows rapid evacuation of the hydraulic fluid from the second pressure line 187 and a correspondingly rapid withdrawal of the load shoe 18. The rapid withdrawal capabilities of this arrangement provide further protection from overheating of the jacket 12 when the web is unexpectedly broken. Accordingly for this preferred kind of calender the separating mechanism comprises two mechanisms. Firstly, the actuator 20 moving the load shoe 18 and secondly the lever arm mechanism 94,95,96 moving the heated roll 22. Also for this embodiment the separating mechanism is controlled by the above mentioned control circuit 98, such that a gap is formed as soon as the detecting device 99 detects a break of the fiber web. However here firstly the load shoe is moved as explained above, such that the load shoe is allowed to quickly move back to its resting position and thereby creating a gap corresponding to the distance between the unloaded jacket and the heated roll, i.e. normally about 7 mm. This distance is sufficient for reducing the heat transfer to acceptable levels, especially if the jacket is rotated at the same time in accordance with the invention. Thereafter the second part of the separating mechanism is separated in order to allow a sufficiently large gap (normally at least 40 mm, but less than 100 mm) to allow a new web to be introduced into the gap. As mentioned above both rolls are rotating at the desired speed once the new web is introduced into the gap. Subsequently the lever arm is moved to position the heated roll in its "nip position" and finally the load shoe is activated to urge the jacket against the heated roll to close the nip. It is evident that it is much easier to make a quick move of the load shoe than of the much heavier heated roll. Accordingly this embodiment is a very effective solution of the problem of avoiding over heating of the flexible belt.

As explained above, in order not to have an excessive heat transfer from the counter-roll 22 to the tapered jacket zones, outside the nip, 12A, 12C of the flexible jacket also these parts have to be at least partially covered by the fiber web during operation. As a consequence there will exist two non-calendered strips 80A, 80B at each end of the fiber web. The thickness of these strips are then of course larger than the thickness of the rest of the web. Accordingly, such a fiber web could not be rolled up without problems.

This latter problem may be solved in different ways. The first way of solving it is to arrange a further calendering subsequently after the nip 1 (or optionally also before) wherein merely these strips 80A, 80B are calendered. Alternatively, the strips may be cut away before the fiber web is rolled up.

Figure 4:
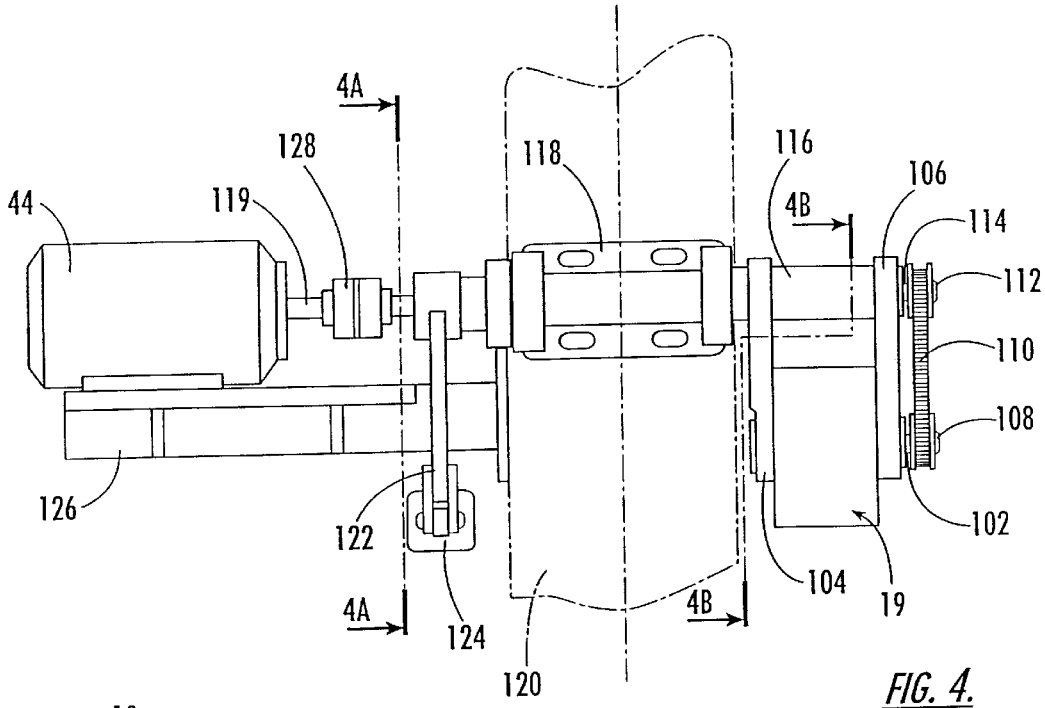
FIGS. 4, 4A and 4B show a preferred solution of a drive arrangement as schematically shown in FIG. 2B, FIGS. 5A, 5B and 5C show yet another embodiment for the drive arrangement according to the invention.

In FIG. 4 there is shown a side view of a preferred embodiment of arranging the direct drive of the enclosed shoe roll 10, by means of frictional engagement (the same principle as shown in FIG. 2B). Accordingly, there is shown a torque transmitting wheel 19 having an outer rubber layer 19A, which is intended for interaction with the surface 15 of each end wall 24, 26. Hence, there are two drive arrangements of the same kind, one arranged at each side of the enclosed shoe roll for transmitting force to each end wall 24, 26. The synchronization is achieved by having one drive being a master and the other being the slave. During an acceleration the master is supplied with a substantially larger torque than the slave, normally 2/1.

A control circuit controls the speed of the wheels. If one wheel has a speed that differs from the speed of the other wheel, this means that one wheel is slipping and the power supply will then be adjusted accordingly such that slipping is eliminated. When two drives are synchronized in this way, the drive shaft 48 of the embodiment disclosed in FIG. 2B becomes redundant and can be eliminated.

The drive wheel 19 is fixedly attached to a first shaft 102, which is rotatably mounted within two support levers 104 and 106. At the end of the shaft 102 there is mounted a toothed wheel 108. The toothed wheel 108 is powered by means of a flexible toothed belt 110, which in turn is powered by a second toothed wheel 112 fixedly attached to the end of a drive shaft 114, which is powered by an induction motor 44. The drive shaft 114 is rotatably arranged within a casing 116. The casing in turn is rotatably mounted to a support structure 118, which is secured to a support beam 120. At the first end of said casing 116, the support levers 104, 106 are fixedly attached thereto. At the other end of said casing 116 there is fixedly attached a lever arm 122, which at its end is mounted to a hydraulic piston assembly 124. The engine 44 is mounted on a separate support structure 126, which also is attached to the support beam 120. The drive shaft 119 protruding from the engine 44 is interconnected with said other drive shaft 114 by means of a coupling device 128.

Figure 4A:
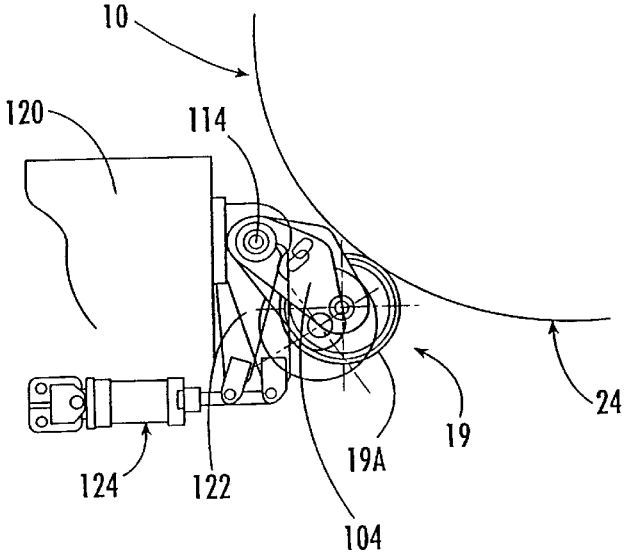

FIG. 4A is a side view of the enclosed shoe roll 10 according to invention showing how the drive arrangement according to FIG. 4 interacts with the roll. The view is a cross section along lines A—A of FIG. 4. As can be seen, the hydraulic piston assembly 124 is adjustably secured to a support structure, preferably forming an integral part with the support beam 120. As is evident from FIG. 4A, the driving wheel 19 can be moved in or out of contact with an end wall 24, 26, by means of moving the hydraulic piston 124 such that the lever arm 122 is pivoted about the drive shaft axis 114. As a consequence of the pivoting of the lever arm 122, also the support levers 104, 106 carrying the drive wheel 19 will be moved. If the engine 44 is in operation, the toothed wheel 112 will pull the toothed belt 110 to rotate the second toothed wheel 108 which causes the shaft 102 and also the driving wheel 19 to rotate.

Figure 4B:
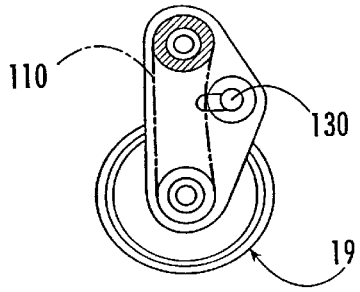

FIG. 4B is a cross section along the line B—B of FIG. 4, which shows an adjustment device for adjusting the tension of the toothed belt 110. A support wheel 130 is adjustably attached to the outer support lever 106, such that it can be positioned to exert the desired pressure on the toothed belt.

Figure 5A:
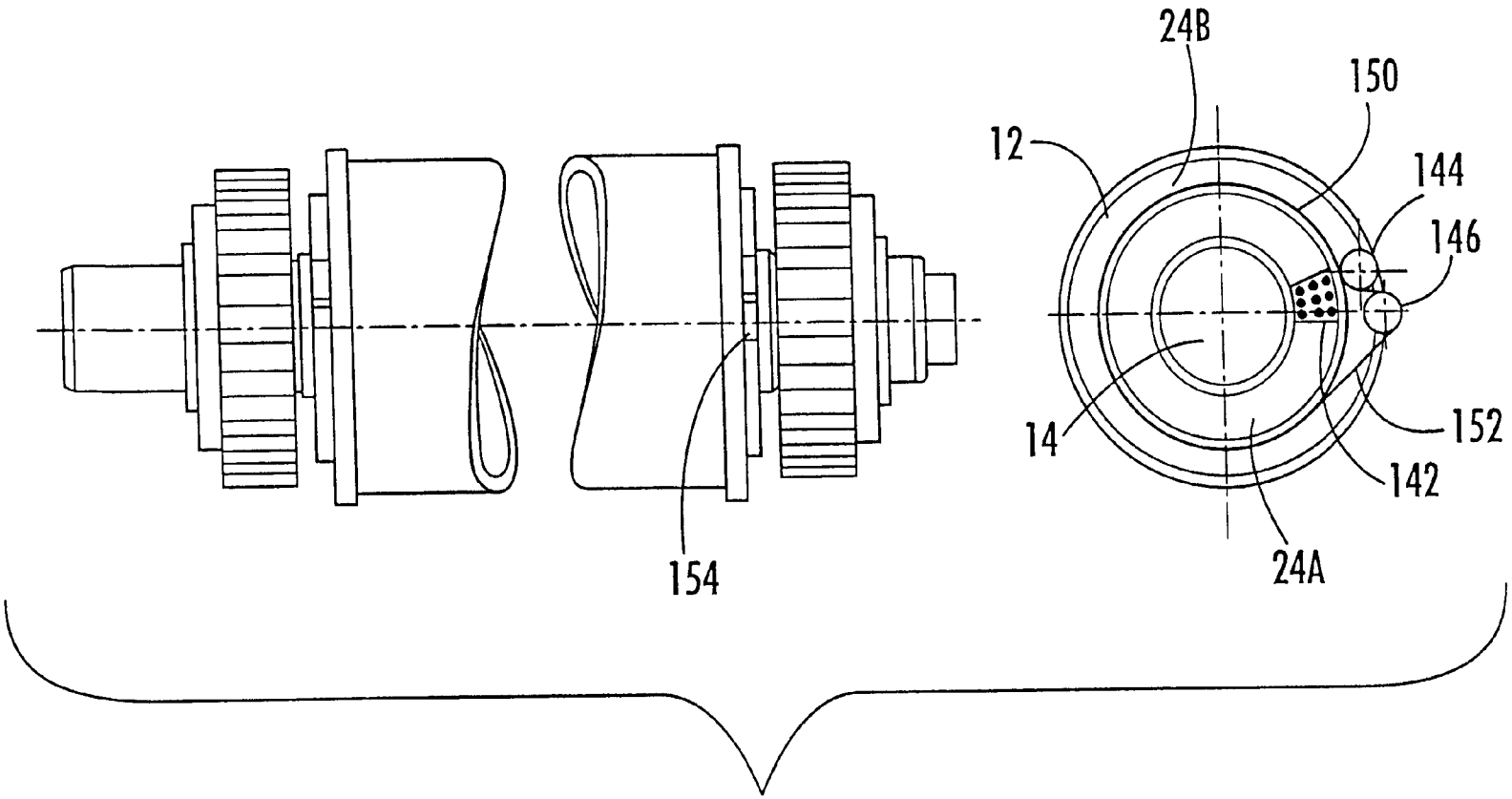
Figure 5C:
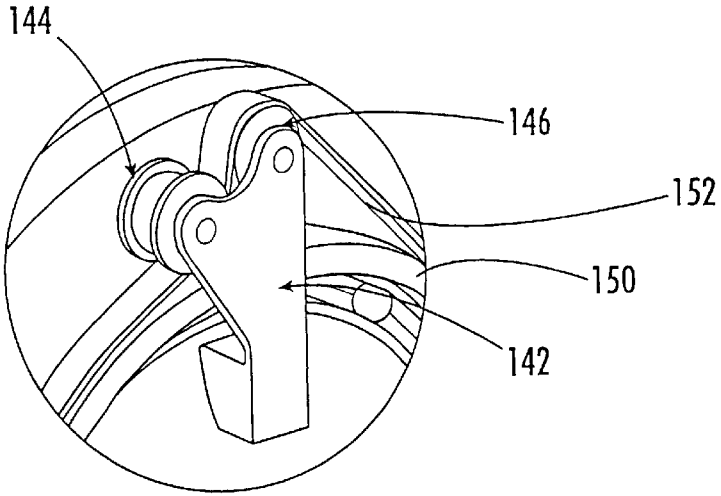
Figure 5B:
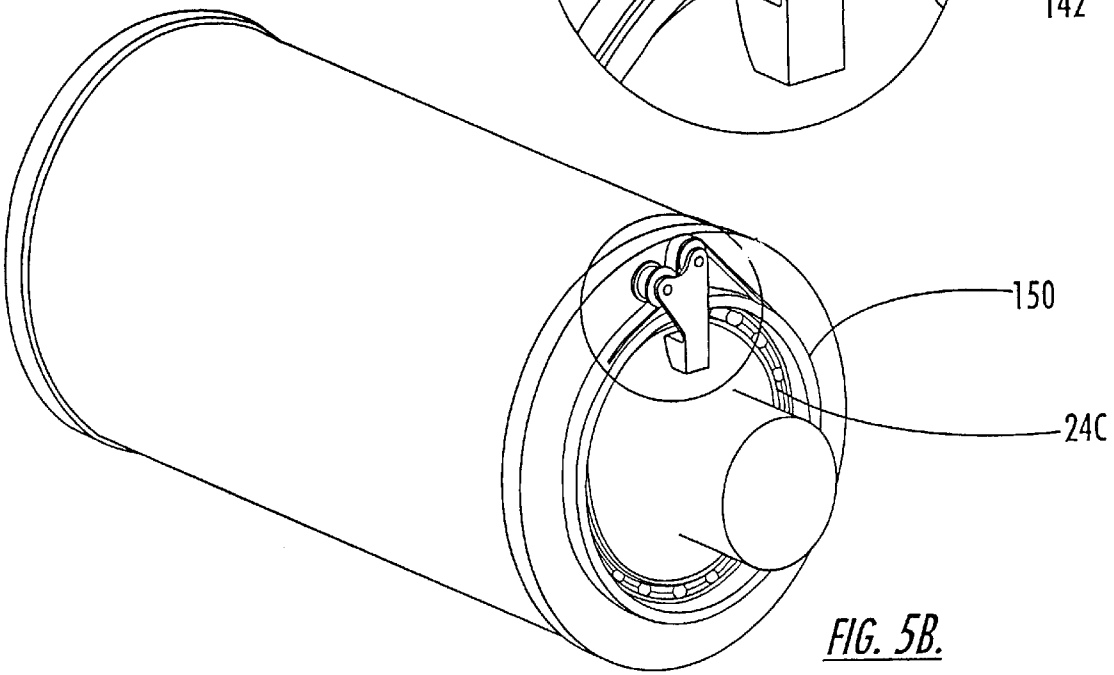

In FIGS. 5A and B there is shown an alternative manner of driving an enclosed shoe roll principally functioning as the embodiment shown in FIG. 2B. Accordingly, also this embodiment has a central support beam 14 passing through the roll, which forms the basic support for the rotating end walls carrying the flexible jacket 12. To the static part 24A of the end wall 24 there is fixedly secured a support structure 142. To said support structure 142 there are arranged a first toothed wheel 144 and a second toothed wheel 146. In sealing engagement with the static part of the end wall 24A there is a rotating part 24B of the end wall. To this rotatable end part 24B there is securely attached a toothed wheel 150. A toothed belt 152 is arranged to partly encircle the toothed wheel 150 and also the driving toothed wheel 146. The first toothed wheel 144 is arranged to apply an optimal pressure to the toothed belt. Also on the other side of the roll there may be exactly the same arrangement positioned according to a mirror image of the first arrangement. The drives (not shown) of both sides are synchronized to drive each side with exactly the same speed, either mechanically or by computer control.

By driving the first toothed wheel 146 the toothed belt 152 will make the toothed wheel 150 to rotate and thereby causing the jacket 12 which is fixedly attached to the rotating part 148 of the end wall to rotate.

Figure 6:
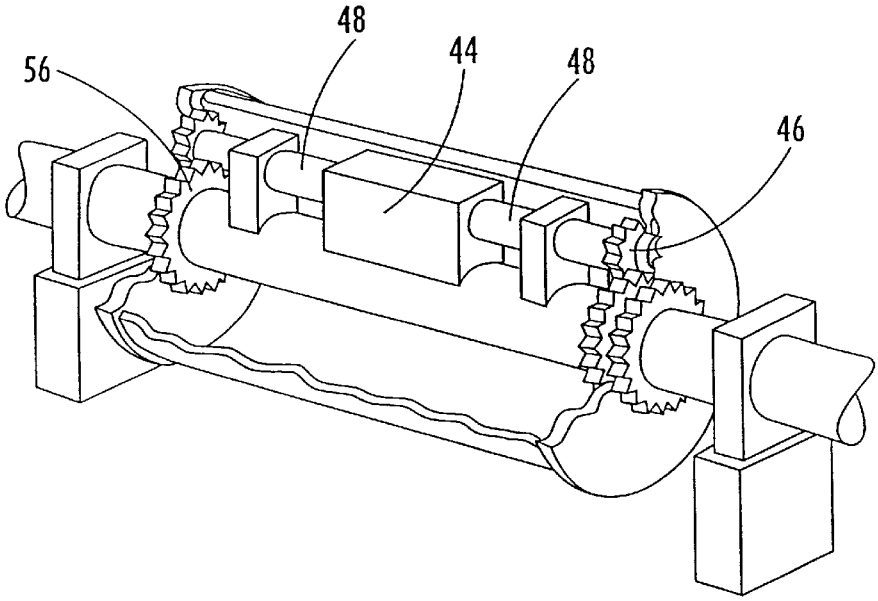
FIGS. 6–7 show different embodiments of how the drive arrangement of the enclosed shoe roll may be achieved.
Figure 7:
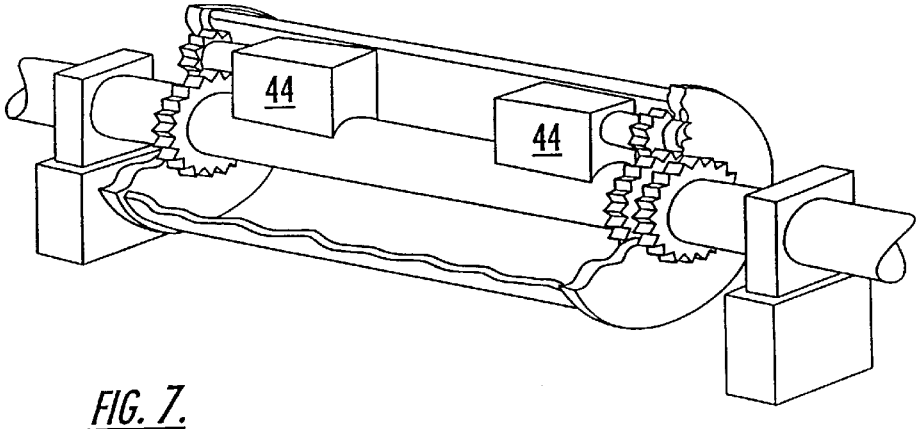

FIGS. 6 and 7 show different variants of the present invention of driving the enclosed shoe roll. In FIG. 6 the drive 44 is placed inside the shoe roll driving two drive shafts 48 which in turn mesh with cog wheels 46, 56 attached to the inside of the end walls.

The embodiment of FIG. 7 is similar to the one of FIG. 6 but with the difference that it is arranged with two drives 44 acting directly on the respective cog wheel of the end walls.

Figure 8:
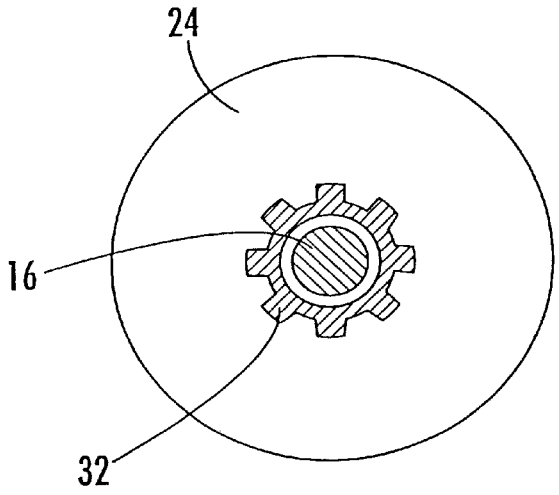
FIGS. 8–10 are cross sectional views along the line II—II in FIG. 2A, which show different embodiments of one aspect of the drive arrangement, and FIGS. 11A, B show a preferred embodiment of a preceding calender device for calendering side strips of the web.
Figure 9:
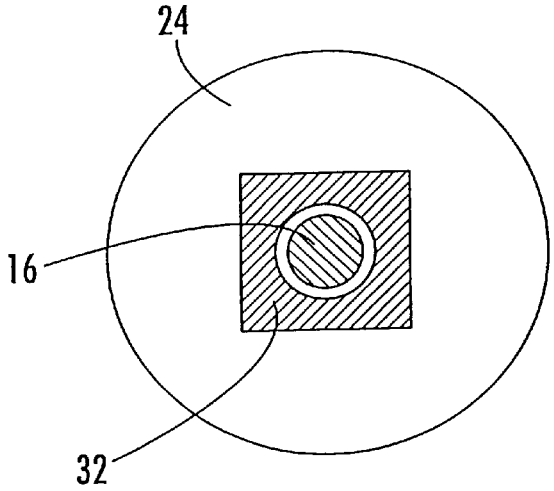
Figure 10:
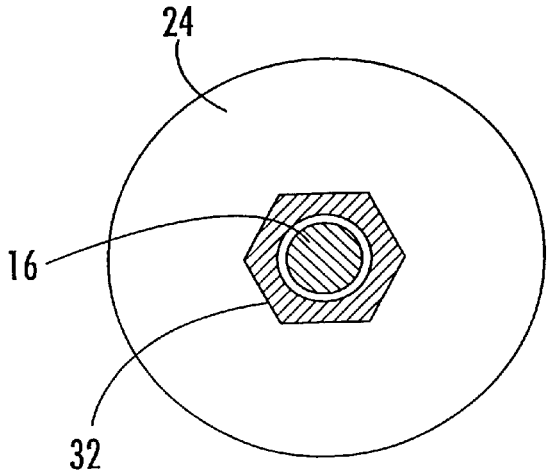

In FIGS. 8 to 10 there is shown different embodiments of how to include the function of having the end walls displaceable in a design as shown in FIG. 2A. Such a device is known per se and described in U.S. Pat. No. 5,084,137 (which document is herewith incorporated for reference). According to said prior art document an hydraulic unit is arranged displacing both end walls in an axial direction by in fact displacing the inner ring of each end wall support being, as in the preferred mode of this invention.

According to the embodiment shown in FIG. 2A, however, the end wall is not divided as in FIG. 2B but is rotatably attached to rotate the cylindrical shaft, i.e. it is necessary to keep the rotational connection. FIGS. 8 to 10 show different possible cross sections of the stub shaft, the cylindrical shaft and the end wall enabling an axial displacement of the end wall relative to the cylindrical shaft while maintaining the rotational connection. The end wall is provided with a through-hole with a certain profile and the cylindrical shaft is provided with a corresponding profile, with some clearance between them, enabling the end wall to slide along the cylindrical shaft. The hydraulic unit acts on the end walls to displace it along the shaft, thereby controlling its position and the tensioning of the jacket. For operation the tensioning arrangement and controlling the tension of the jacket, reference is made to U.S. Pat. No. 5,084,137.

Figure 11B:
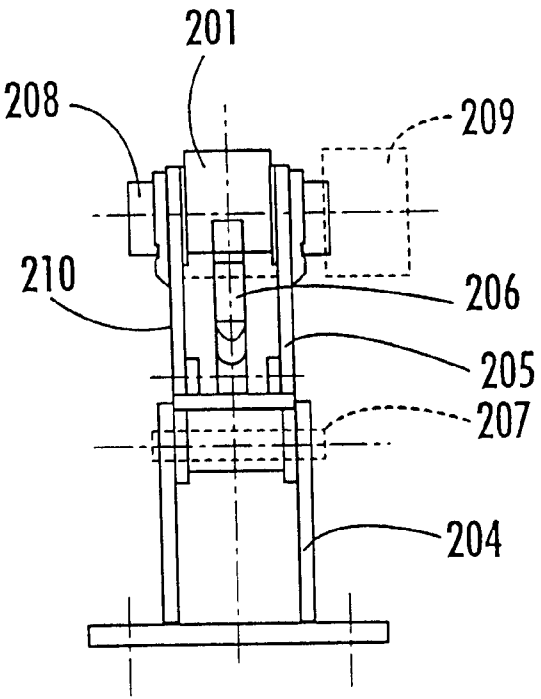
Figure 11A:
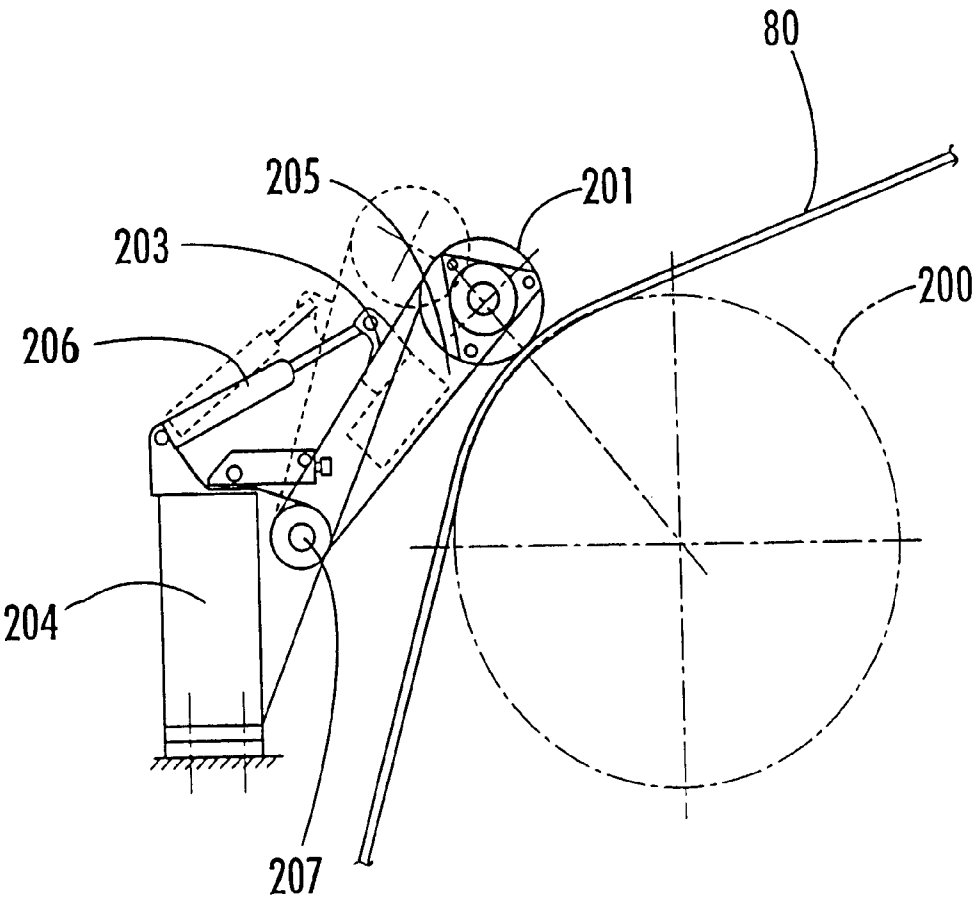

In FIG. 11A there is shown a side view of a preferred device for a preceding step for merely calendering the strips 80A, 80B which are not treated within the extended nip 1. A roll 200 preceding the extended nip 1 is mounted within in a conventional basic structure (not shown). Counteracting the roll 200 there is a small roll 201, having a width of about the same as distance between the side edge of the load shoe and the inner face of the end wall, which in the shown embodiment is about 150 mm. The small roll 201 is rotatably mounted within a support structure having two parallel pivot arms 205, 210. These arms 205,210 are pivotally attached to a fixed support member 204, by means of a shaft 207. The position of the arms 205, 210 are controlled by hydraulic piston assembly 206, which is attached to said arms 205,210 via plates 203 at one end and to said support member 204 at the other end. Normally the roll is not powered but driven by means of friction when in contact with the fiber web 80. Optionally it may be powered by a separate drive 209 as indicated in FIG. 11B. The function of the calender is basically the same as described above. Once the web 80 is in place on the roll 200 the hydraulic piston is activated to move the small roll 201 in contact with the web and to exert a desired pressure against a strip at the edge of the web. The roll 200 passes along the whole width of the web and at the other end of the web there is also positioned a corresponding arrangement with a second small roll calendering the other strip. Afterwards the web will have a substantially equal thickness all over such that it may be rolled up without any problems.

It is to be understood that the present invention is not limited to the embodiments and shown in the drawings, but may be modified within the scope of the claims. For instance, instead of having pair-wise hydraulic pistons 20 as shown in FIG. 1 only one row of hydraulic piston may be used. Furthermore, it is evident for a skilled person that said end walls 24, 26 may have a design that differs from what is shown above. For instance, if a friction drive acts directly on the end wall, it may be advantageous to have an outer segmented periphery which can be easily exchanged after a certain time of wear. Moreover, the skilled person realizes that if a separate force transmitting device is used, this force transmitting device 15 for transmitting the frictional force may be attached to the end wall in many different ways, for instance by means of screws, welding, gluing, etc. Also the material of said device 15 may vary. Although some kind of stainless steel is preferred. Alternatively the force transmitting device may be built into the jacket, e.g. a reinforced extra thick layer for interaction with a friction based drive. The drive has mostly been schematically shown, but would in the preferred case be provided by means of an electrically powered engine, preferably a frequency controlled induction motor. However, also e.g. hydraulic drive units or drive units powered by fuel may of course be used. The manner of achieving the movement of the heated roll out of or into the nip as well as also the movement of the independent drive of the enclosed shoe roll may also be provided for by many different means, although hydraulically powered systems would be preferred. It is further evident that any existing different solutions may be used for achieving the detecting device 99, for detecting if the fiber web 80 is broken, e.g. optical sensors, electric-magnetic sensors etc. Further, instead of having one stationary support beam, two or more may be used, in order to obtain the desired supporting structure of the enclosed shoe roll. Moreover, the skilled person realizes that the separating mechanism exemplified above may be achieved in many other ways, e.g. by means of having one or both rolls slidingly arranged at its/their ends, by the use of screw jackets instead of hydraulic units, etc. It is also understood that the separate driving mechanism for the enclosed shoe roll might be disconnected once the calender is in operation, but in some cases it might be preferable to have it connected also during operation, since it eliminates the need of a disconnecting mechanism, it also reduces the power consumption of the main drive and also eliminates any disadvantage that could arise (e.g. drag in jacket) during acceleration of the separate drive. Moreover it should be noted that the invention is not limited to the temperatures defined above, but may vary in dependence of specific needs. It is also understood that the invention is not limited to the use in connection with enclosed shoe-rolls but may, at least in parts, also be applied in connection with shoe press units using open ended belts, i.e. imparting movement directly to the flexible belt (without using end walls) especially in relation to the basic principle of operating a calender according to the invention. Finally it is evident that the invention may be used in connection with different kind of flexible belts, e.g. also belts not only being flexible but also elastic, e.g. rubber type belts.

That which is claimed is:

1. A method of calendering a fibrous web between a counter element and a tubular flexible jacket, said method comprising the steps of:

advancing the fibrous web between the counter element and the tubular jacket;

heating the counter element to apply heat to the fibrous web;

applying pressure to the inside of the tubular jacket, thereby engaging the tubular jacket against the counter element to calender the web under heat and pressure between the jacket and the counter element;

detecting for breaks in the web at a position that would indicate an absence of the web between the counter element and the tubular jacket; and when a break is detected;

driving the tubular flexible jacket independently from the counter element to prevent excessive heat from being transferred from the counter element to the tubular flexible jacket in the absence of the fibrous web being interposed therebetween.

2. A method of calendering as defined in claim 1 wherein said step of applying pressure comprises moving a load element for pressing the flexible tubular jacket radially outwardly against the counter element such that the flexible jacket is deflected by said load element to follow a path of travel adjacent the counter element which is radially outward from the position of the flexible jacket in an undeflected condition.

3. A method of calendering as defined in claim 1 wherein said step of applying pressure comprises moving a load element inside the tubular jacket and the counter element toward each other so that the tubular jacket is deflected and the ends of the jacket are moved towards each other.

4. A method of calendering as defined in claim 3 comprising the further step of separating the counter element and the load element when a web break is detected.

5. A method of calendering as defined in claim 4 wherein said separating step further comprises;

supplying hydraulic fluid to at least one hydraulic cylinder having a two-sided piston with a first side in communication with a first pressure line for withdrawing the load element from the counter element and a second side in communication with a second pressure line for pressing the load element against the counter element, increasing the pressure in the first pressure line to apply pressure to the respective side of the piston; and communicating the pressure in the first pressure line to a pilot check valve in the second pressure line so as to open the pilot check valve and evacuate hydraulic fluid from the second pressure line.

* * * * *

UNITED STATES PATENT AND TRADEMARK OFFICE

CERTIFICATE OF CORRECTION

PATENT NO. : 6,213,009 B1
DATED : April 10, 2001
INVENTOR(S) : Säfman et al.

It is certified that error appears in the above-identified patent and that said Letters Patent is hereby corrected as shown below:

Title page,
Item [75] Inventors, "Nils-Erik Sätman" should read -- Nils-Erik Säfman --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*